United States Patent [19]

Friedli et al.

[11] 4,172,023

[45] Oct. 23, 1979

[54] PROTECTIVE ELECTRODE SLEEVE

[75] Inventors: Hans Friedli; Robert Moser, both of Steg, Switzerland

[73] Assignee: Swiss Aluminium Ltd., Chippis, Switzerland

[21] Appl. No.: 967,691

[22] Filed: Dec. 8, 1978

[30] Foreign Application Priority Data

Dec. 16, 1977 [CH] Switzerland ..... 15494/77

[51] Int. Cl.[2] ..... C25B 9/02

[52] U.S. Cl. ..... 204/286; 204/280; 204/294

[58] Field of Search ..... 204/243 R, 243 M, 244, 204/286, 245, 294, 280

[56] References Cited

U.S. PATENT DOCUMENTS

| | | | |
|---|---|---|---|
| 2,528,905 | 11/1950 | Ollivier et al. | 204/243 R |
| 2,773,825 | 12/1956 | Newcombe | 204/243 R |

*Primary Examiner*—R. L. Andrews

*Attorney, Agent, or Firm*—Bachman and LaPointe

[57] ABSTRACT

A sleeve or collar for protecting the iron pin of an anode connecting rod set in the carbon anode block used in the electrolytic production of aluminum is made out of aluminum or aluminum alloy sheet. Parts of at least two facing sides of the rectangular or square shaped sleeve project inwards in such a manner that they clamp onto the iron anode pin.

9 Claims, 5 Drawing Figures

PROTECTIVE ELECTRODE SLEEVE

BACKGROUND OF THE INVENTION

The invention concerns a sleeve made of aluminum or an aluminum alloy for protecting the iron pins of an anode block used as a carbon block or anode in the electrolytic production of aluminum.

The baked carbon anodes used in the electrolytic production of aluminum from a molten, fluoride-containing electrolyte are usually provided with anode conductor bars with two or four pins or plugs made of iron. The iron pins are set in the upper part of the carbon anode and embedded securely there by ramming with a granular or pasty mass of carbon, or by pouring a molten anode carbon paste around them. The cross section of the carbon anode is for example about 500×1000 mm to 500×1500 mm and the height 400 mm to 550 mm. The carbon anode is connected by means of the iron pins to the anode conductor bars and the latter connected to the electrical supply by way of clamps.

After the carbon anode is mounted in the pot, its head heats up to about 180° C. After six days the temperature there rises on the average to about 400°-500° C. Because of combustion of the anode by the oxygen released in the reduction process, the anode must be lowered by about 15 to 20 mm per day. Finally it lies so low that the iron pins also lie below the surface of the molten electrolyte. The ends of the pins are protected from this mass by the carbon mass surrounding them, but the part projecting out of the anode is not. In order that this does not scale away and dissolve partially in the electrolyte, the part of the anode pins projecting out of the carbon anode must also be protected. This can for example be achieved using a mass of artificially produced carbon (coke/pitch mixture), in that this material is poured into a sleeve around the iron in a recess in the anode. A kind of sleeve made of aluminum sheet—also called a collar—is very suitable for this purpose, as the aluminum does not contaminate the bath when it melts off, and is recovered in the cathodic aluminum layer in the cell.

A sleeve, about 250×100 mm in plan view and 100 to 200 mm high, can be used for example for an iron anode pin of 200×50 mm. The sheet is, e.g., about 1 mm thick. Usefully hard rolled pure aluminum sheet—the purity and surface condition of which is of almost no importance—is used for the production of the sleeve. Scrap sheet can therefore also be used. Of course alloys of aluminum can also be considered for this purpose, provided they do not contain such large quantities of alloying elements that the aluminum produced in the pot is unduly contaminated.

The recesses in the head of the carbon anode correspond in number and dimensions to those of the sleeves which fit neatly into these rectangular or square recesses.

FIG. 1 shows an aluminum sleeve representing the state of the art and is for an iron pin which is square in cross section. The sleeve is made out of a strip of sheet both ends of which are joined by a fold. This sleeve is shown in horizontal cross section as it comes out after automatic production. In the example shown it is approximately square in cross section. The end part 11 of the wall length 10 is bent inwards and the end part 12 of the wall length 13 is bent outwards. The bent ends 11 and 12 must be engaged on one another and knocked or pressed flat, so that a folded joint is obtained and that the sleeve does not open on being filled with the carbon mass. The horizontal cross section is then almost completely square in shape, and the sleeve can be set in the square recess in the head of the anode.

This and similar known types of sleeve have the disadvantage that, on inserting them into the recess, they have to be adjusted, so that they are at the same distance from the iron pin all round. There is also the disadvantage that they move easily out of position while being filled with the pasty carbon mass; inhomogeneities which impair the mechanical properties of the anode can result from this. The object of the invention is therefore to develop a sleeve, which is made of aluminum or an aluminum alloy, and which protects the iron pins of an anode connecting rod set in the carbon blocks used as anodes in the electrolytic production of aluminum, whereby the said sleeve does not exhibit the above mentioned disadvantages, but can still be manufactured in a simple and economic manner.

SUMMARY OF THE INVENTION

The object is achieved by way of the invention in that at least two facing sides of the rectangular or square shaped sleeve project inwards in such a manner that they are clamped on to the iron pin.

The sleeve—as was already mentioned in describing the present state of the art—is made of a strip of aluminum or suitable aluminum alloy sheet which is bent to a rectangular or square shape and the ends joined by means of a fold.

The parts of the sleeve which project inwards can first of all be stamped into the sheet—in particular in the upper half of the sleeve—and then bent inwards. The flap bent inwards can in principle be of any imaginable, suitable geometric form; simple shapes, however, such as rectangles, trapeziums, or semi-circles are preferred.

Although any number of parts can be bent inwards from each side of the sleeve, it is advantageous for practical and economic reasons to stamp out one flap on each of two facing sides of the sleeve and to bend these inwards.

According to a further development of the invention the flaps, which are on two facing sides, are broader than the iron pins which they clamp onto after being bent. A recess of the same width as the iron pin can be stamped out of these flaps. When the flaps are bent inwards, they can then stabilize the protective sleeve further as the groove engages the iron pin and prevents sideways movement of the sleeve.

BRIEF DESCRIPTION OF THE DRAWINGS

The invention will now be explained in greater detail with the help of the following exemplified embodiments and the schematic drawings viz.

DETAILED DESCRIPTION

Figure 1:
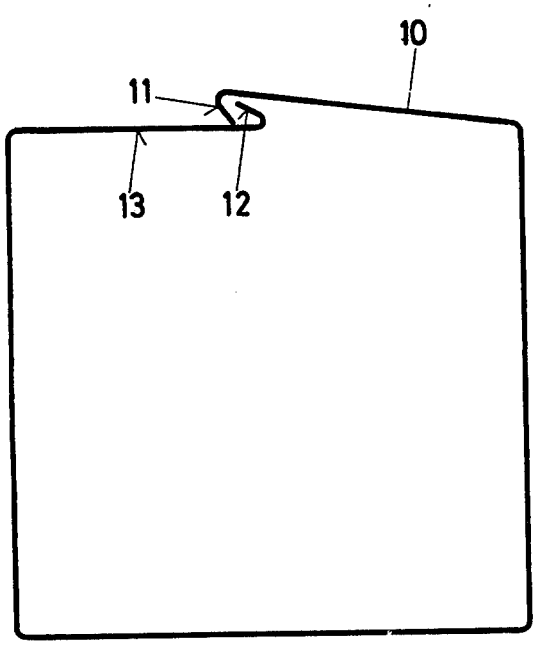
FIG. 1: An aluminum sleeve representing the state of the art.
Figure 2:
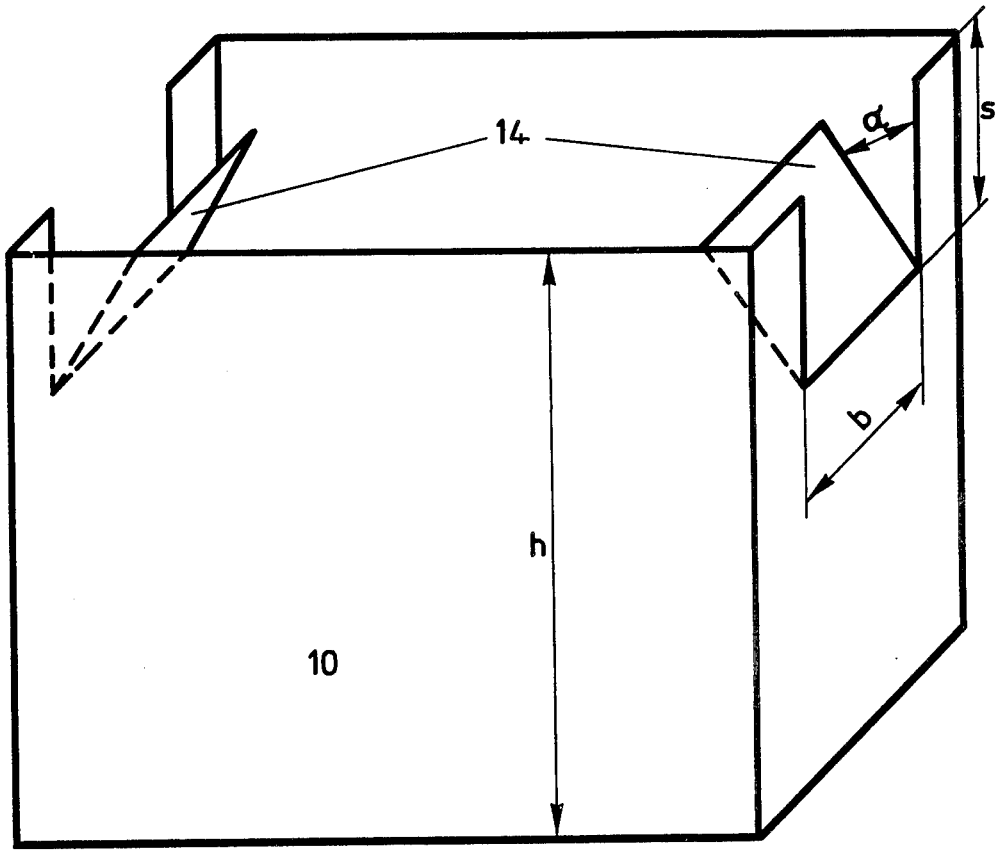
FIG. 2: A protective sleeve with two bent-over flaps shown in a perspective view.

The sleeve shown in FIG. 2 is intended for an iron anode pin which is long and rectangular in cross section. The sleeve is manufactured from a sheet of scrap, industrially pure aluminum. The ends of the sheet are—as were described above and shown in FIG. 1—joined by a fold which is not shown in detail in FIG. 2. Two slits, which are of equal length, are provided on each of the long sides of the sleeve and run down from the top edge of the sleeve walls. After the sleeve is fitted to the carbon block, the flap 14 is bent over inwards, until it clamps onto the iron pin.

The length s of the slit is preferably 15–30% of the overall height h of the sleeve. The length s is in particular preferably chosen so that the angle $\alpha$ between the flap and the sidewall of the sleeve is about 20° to 70°. The breadth b of the flap can in principle be set at will. However it is preferably about the same as the width of the iron anode pin.

A typical sleeve in accordance with the invention is 260 mm in length, 100 mm broad and of height h equal to 200 mm. Four slits are stamped into the sleeve on its broad sides, starting from the upper edge; these are of length s=60 mm and form two flaps each of breadth b=62 mm. The half-hard, pure aluminum sheet used to make the sleeve is 0.8 mm thick. The two flaps formed by the slits in the sheet are bent over at an angle of about 30°.

Figure 3:
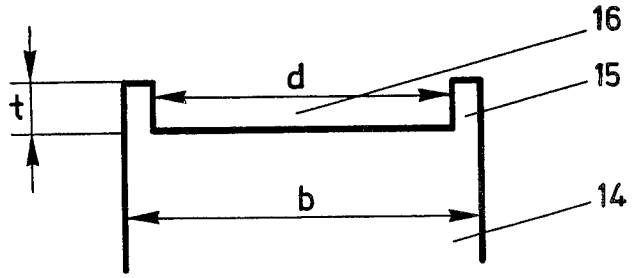
FIG. 3: The upper end of a flap with a recess in it.

FIG. 3 shows a preferred version of the upper end of one flap 14. A recess 16 of width d has been stamped out of this end of the flap. The width d of the recess is marginally greater than the corresponding dimension of the iron pin, so that the flap can be bent over far enough for it to engage the iron pin. Both projecting parts 15 prevent the flap and therefore the sleeve from being moved sideways. In the case of a flap of width b=62 mm which comes to rest against an iron pin which is 50 mm broad, the width d of the recess is approximately 51 to 52 mm. The depth t of the recess 16 can for example be 5 mm.

Figure 4:
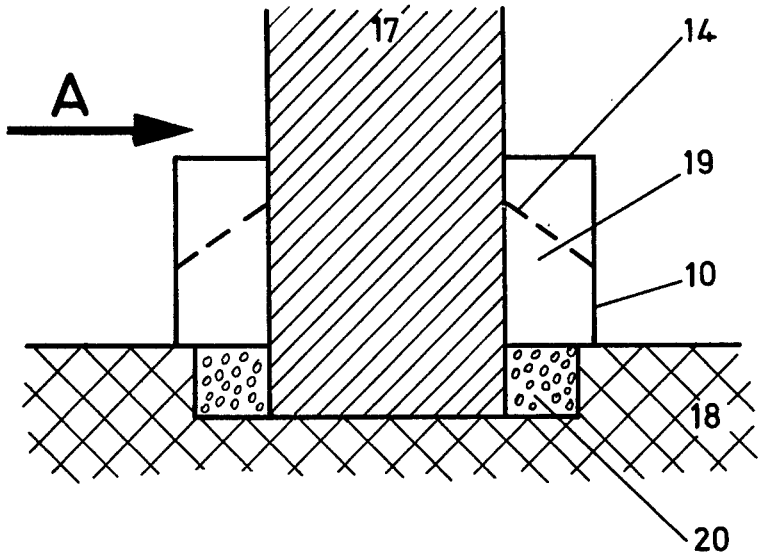
FIG. 4: A vertical section perpendicular to the side with the bent-over flap.

FIG. 4 shows an iron pin 17, which is square in cross section, held in a recess of the anode block 18 by means of cast iron or carbon 20. Set on top of the anode block is a sleeve 10 with two flaps 14 which are bent sideways and clamp on to the iron pin 17. The flaps stabilize the sleeve and ensure that it does not change its position as the carbon paste is poured into the space 19 between the sleeve and the pin 17.

Figure 5:
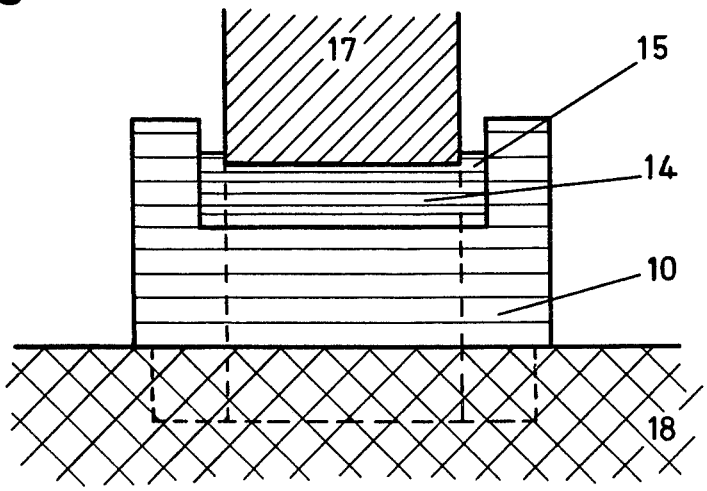
FIG. 5: A sideview of the embodiment shown in FIG. 4, viewed here in the direction indicated by the arrow A.

It can be seen from FIG. 5 that the bent over flap has two projecting parts 15 which make a recess which is filled by the pin 17.

What is claimed is:

1. A sleeve of aluminum or an aluminum alloy for the protection of the iron pin of an anode connecting rod in a carbon block used as the anode in the electrolytic production of aluminum, wherein said sleeve is rectangular or square shaped and the iron pin fits therein in spaced relationship thereto and wherein parts of at least two facing sides of the rectangular or square shaped sleeve project inwards towards said pin in such a manner that they clamp onto and engage the iron anode pin and stabilize the sleeve, with said sleeve maintaining a spaced relationship to said pin.

2. A sleeve according to claim 1 wherein the parts of the upper edge of the sleeve projecting inwards are flaps stamped into the material of the sleeve and bent inwards.

3. A sleeve according to claim 2 wherein a flap is stamped into each of two facing sides of the sleeve and bent inwards.

4. A sleeve according to claim 3 wherein both of the flaps are provided with recesses which correspond approximately to the dimension of the iron anode pin.

5. A sleeve according to claim 4 wherein said flaps include projecting parts adjacent said recesses which prevent the sleeve from being moved sideways.

6. A sleeve according to claim 2 wherein the length s of the flap is from 15–30% of the height h of the sleeve.

7. A sleeve according to claim 6 wherein the flap forms an angle of from 20°–70° with the sidewall of the sleeve.

8. A sleeve according to claim 2 wherein said flaps are broader than the iron pin.

9. A sleeve according to claim 1 made of a strip of said aluminum or aluminum alloy bent to a rectangular or square shape, with the ends thereof joined by means of a fold.

* * * * *